US009352390B2

(12) United States Patent
Chen et al.

(10) Patent No.: US 9,352,390 B2
(45) Date of Patent: May 31, 2016

(54) VACUUM CONTAINER AND VACUUM FORMING DEVICE USING THE SAME

(71) Applicant: JI ZHUN PRECISION INDUSTRY (HUI ZHOU) CO., LTD, Huizhou (CN)

(72) Inventors: Tang-Quan Chen, Shenzhen (CN); Xian-He Li, Shenzhen (CN); Yi-Min Jiang, Shenzhen (CN)

(73) Assignee: JI ZHUN PRECISION INDUSTRY (HUI ZHOU) CO., LTD., Huizhou (CN)

( * ) Notice: Subject to any disclaimer, the term of this patent is extended or adjusted under 35 U.S.C. 154(b) by 0 days.

(21) Appl. No.: 14/318,812

(22) Filed: Jun. 30, 2014

(65) Prior Publication Data

US 2015/0000857 A1 Jan. 1, 2015

(30) Foreign Application Priority Data

Jul. 1, 2013 (CN) ..... 2013 1 02700583

(51) Int. Cl.
*B22D 27/15* (2006.01)

(52) U.S. Cl.
CPC ..... *B22D 27/15* (2013.01)

(58) Field of Classification Search
CPC .. B22D 27/15; B29C 37/006; B29C 37/0064; B29C 39/22; B29C 39/44
See application file for complete search history.

(56) References Cited

U.S. PATENT DOCUMENTS

2008/0223538 A1 9/2008 Ashburn et al.
2012/0211193 A1 8/2012 Bochiechio et al.

FOREIGN PATENT DOCUMENTS

JP 08075015 A 3/1996
JP 2001012650 A 1/2001
JP 2004154788 A 6/2004

*Primary Examiner* — Kevin P Kerns
*Assistant Examiner* — Steven Ha
(74) *Attorney, Agent, or Firm* — Novak Druce Connolly Bove + Quigg LLP

(57) ABSTRACT

A vacuum container includes a connecting chamber a valve chamber, a discharging chamber, and a sealing member. The connecting chamber defines an inclined sealing surface. The discharging chamber defines a discharging passage therein. The valve chamber interconnects the connecting chamber and the discharging chamber. The sealing member is slidably received in the valve chamber, wherein the sealing member is configured for sliding toward the sealing surface, such that the sealing member resists the inclined sealing surface to hermetically isolate the connecting chamber from the discharging chamber.

19 Claims, 4 Drawing Sheets

VACUUM CONTAINER AND VACUUM FORMING DEVICE USING THE SAME

FIELD

The present disclosure generally relates to a vacuum forming device, and more particularly to a vacuum container and a vacuum forming device using the same.

BACKGROUND

In order to form a workpiece, a vacuum container may be employed to maintain a vacuum environment to prevent the workpiece from being oxidized.

BRIEF DESCRIPTION OF THE DRAWING

The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
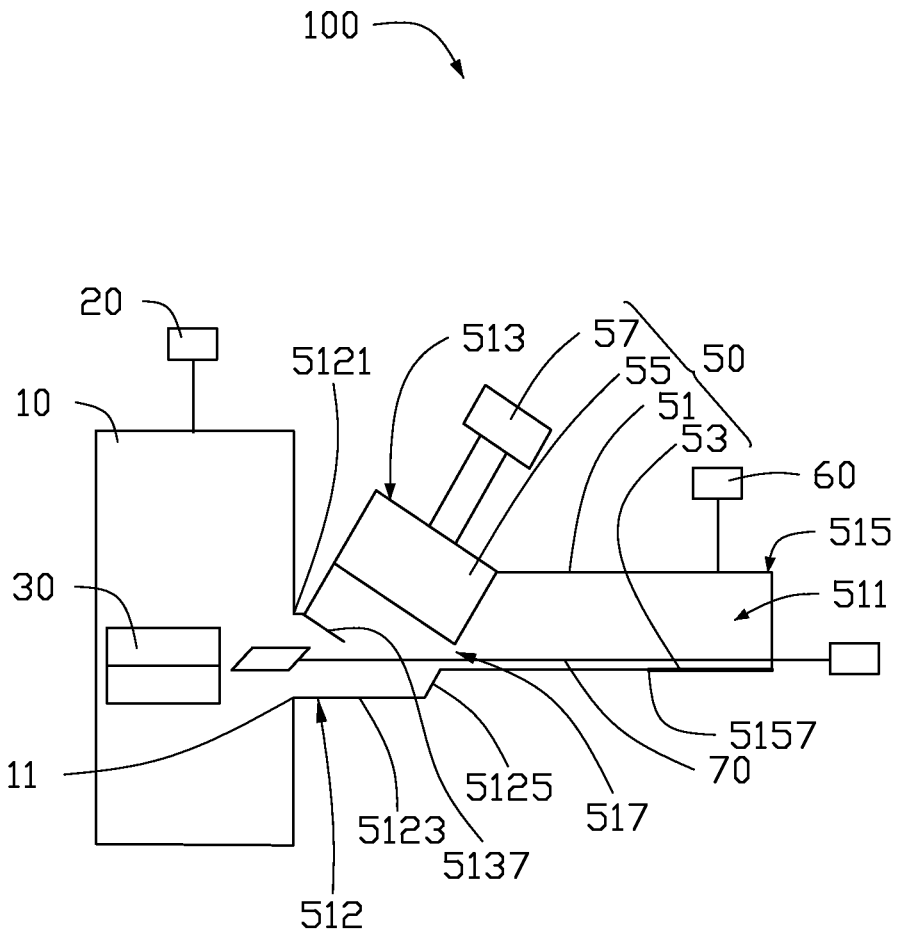
FIG. 1 shows a first embodiment of a vacuum forming device in a first state.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that is modified, such that the feature of the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
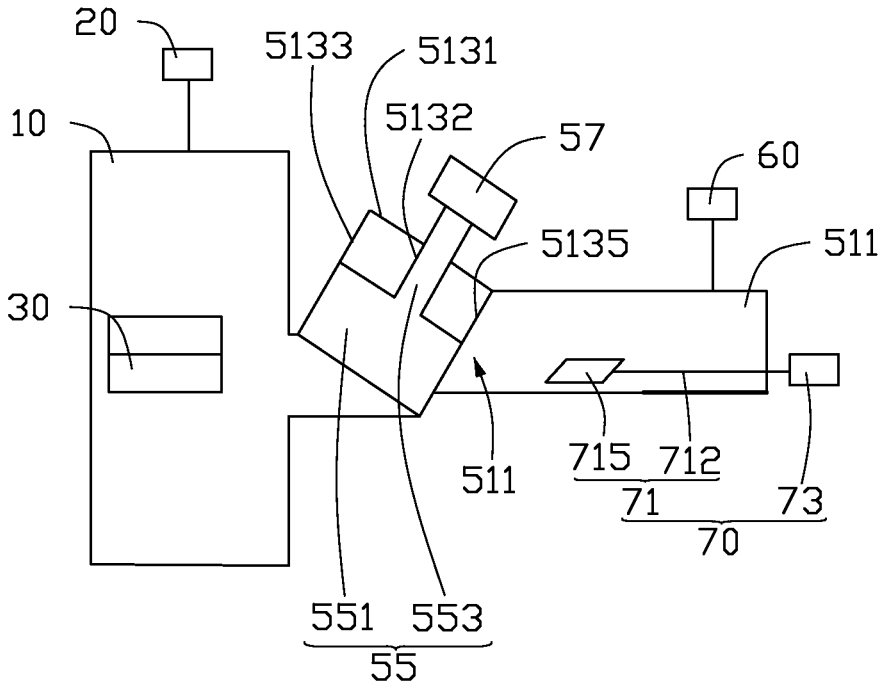
FIG. 2 is similar to FIG. 1, but shows the vacuum forming device in a second state.
Figure 3:
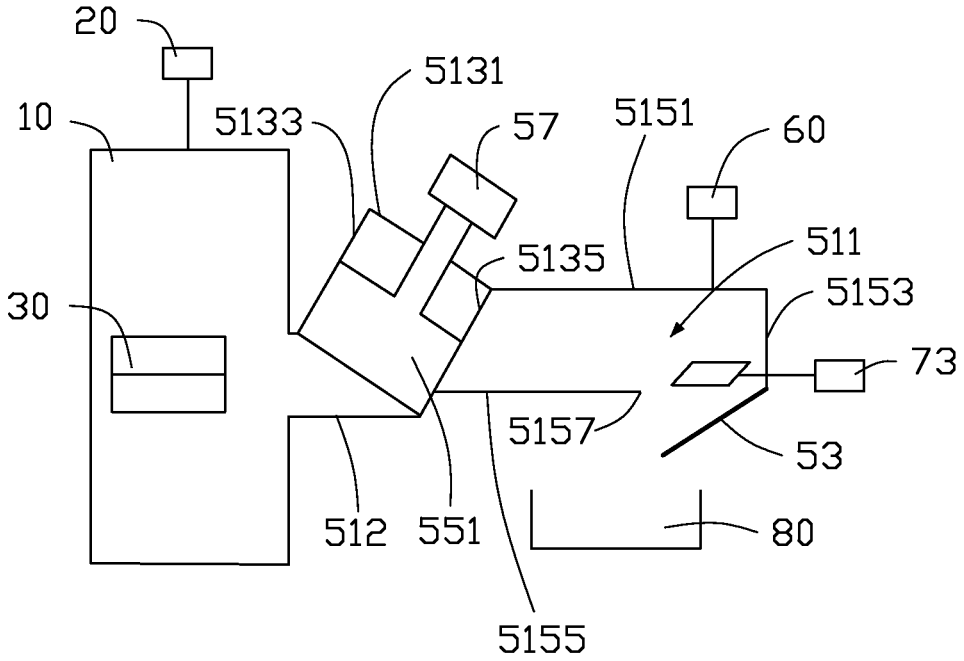
FIG. 3 is similar to FIG. 1, but shows the vacuum forming device in a third state.

FIGS. 1-3 illustrate a first embodiment of a vacuum forming device 100 for casting a workpiece. In the embodiment, the vacuum forming device 100 can be a casting device for casting an amorphous alloy. The vacuum forming device 100 can also be any other machining device equipped with a vacuum container, such as a chemical heat treatment vacuum device. The vacuum forming device 100 can include a vacuum forming chamber 10, a first vacuum pump 20, a mould 30, a vacuum container 50, a second vacuum pump 60, and a discharging assembly 70. The first vacuum pump 20 can be coupled to the vacuum forming chamber 10 for exhausting air from the vacuum forming chamber 10. The mould 30 can be located within the vacuum forming chamber 10 for casting a workpiece. The vacuum container 50 can be assembled to a side of the vacuum forming chamber 10. The second vacuum pump 60 can be coupled to the vacuum container 50 for exhausting air from the vacuum container 50. The discharging assembly 70 can be movably received in the vacuum container 50 for retrieving a workpiece from the vacuum forming chamber 10. The vacuum forming device 100 also can include other structures known in the art, such as an ejection mechanism and a casting mechanism, that are not described herein. In the embodiment, the vacuum forming device 100 can be operated in three different states.

FIG. 1 illustrates a first state of the vacuum forming device 100. In the first state, the vacuum forming chamber 10 fluidly communicates with the vacuum container 50 to enable an air pressure of the vacuum container 50 to be equal to an air pressure of the vacuum forming chamber 10. Thus, the workpiece can be easily moved from the vacuum forming chamber 10 to the vacuum container 50. The vacuum container 50 can include a housing 51, a sealing cover 53, a sealing member 55, and a first driving member 57. The housing 51 can define a connecting chamber 512, a discharging chamber 515, and a valve chamber 513. The vacuum forming chamber 10 can define an assembly hole 11 fluidly communicating with the connecting chamber 512. The valve chamber 513 can fluidly communicate between the connecting chamber 512 and the discharging chamber 515. The connecting chamber 512 can fluidly communicate with the vacuum forming chamber 10 via the assembly hole 11. The housing 51 can further form a connecting surface 5121, a bottom surface 5123, and a sealing surface 5125. The connecting surface 5121 can be a top surface of the connecting chamber 512 and be formed between the vacuum forming chamber 10 and the valve chamber 513. The bottom surface 5123 can be a bottom surface of the connecting chamber 512. The sealing surface 5125 can be coupled to the bottom surface 5123 and slant away from the vacuum forming chamber 10 to couple to the discharging chamber 515.

FIG. 2 illustrates a second state of the vacuum forming device 100. In the second state, the vacuum container 50 is hermetically isolated from the vacuum forming chamber 10 and receives the workpiece. The valve chamber 513 can be substantially cube-shaped. The valve chamber 513 can include a top wall 5131, a first guiding wall 5133, a second guiding wall 5135, and a supporting wall 5137. The top wall 5131 can define an inserting hole 5132. The first guiding wall 5133 can extend substantially perpendicularly from an edge of the top wall 5131 and be coupled to the connecting surface 5121. An angle defined by the first guiding wall 5133 and the connecting surface 5121 of the connecting chamber 512 can be greater than 90 degrees. The second guiding wall 5135 can extend substantially perpendicularly from an edge of the top wall 5131 opposite to the first guiding wall 5133 and enter into the discharging chamber 515. The second guiding wall 5135 can be substantially parallel to the first guiding wall 5133 and substantially coplanar with the sealing surface 5125. In the embodiment, a highest portion of the second guiding wall 5135 can be lower than a highest portion of the first guiding wall 5133. The supporting wall 5137 can be coupled between the first guiding wall 5133 and the second guiding wall 5137. The supporting wall 5137 can be substantially parallel to the top wall 5131. The discharging chamber 515 can be substantially rectangular and define a discharging passage 511 therein.

In the embodiment, the first guiding wall 5133 and the supporting wall 5137 can be spaced from the bottom surface 5123, and the second guiding wall 5135 can be spaced from the sealing surface 5125. A through passage 517 can be defined between the second guiding wall 5135 and the sealing surface 5125. The through passage 517 can interconnect the discharging passage 511 and the assembly hole 11 of the vacuum forming chamber 10. The discharging chamber 515 can include a mounting wall 5151, a side wall 5153, and an outlet wall 5155. The mounting wall 5151 is coupled to a joint portion of the top wall 5131 and the second guiding wall 5135. The mounting wall 5151 and the top wall 5131 can define an angle greater than 90 degrees. The side wall 5153 can extend substantially perpendicularly from an edge of the mounting wall 5151 away from the valve chamber 513. The outlet wall 5155 can be coupled to the sealing surface 5125 and can be substantially parallel to the mounting wall 5151 and the bottom surface 5123.

The outlet wall 5155, the mounting wall 5151, and the bottom surface 5123 can be arranged substantially horizontally. The outlet wall 5155 can be disposed above the bottom surface 5123 and define an outlet 5157 adjacent to the side wall 5153. The sealing cover 53 can be pivotably coupled to the side wall 5153 to seal the outlet 5157.

FIG. 3 illustrates a third state of the vacuum forming device 100. In the third state, the sealing cover 53 is rotated to open the outlet 5157 to allow the workpiece to slide along the sealing cover 53 into a collection container 80 located beneath the vacuum container 50. The sealing member 55 can be movably received in the valve chamber 513. The sealing member 55 can slide toward the supporting wall 5137. The sealing member 55 can include a sealing head 551 and a connecting rod 553 protruding from a side of the sealing head 551. Opposite sides of the sealing head 551 can respectively resist the first guiding wall 5133 and the second guiding wall 5135. An end surface of the sealing head 551 away from the connecting rod 553 can abut against the supporting wall 5137. The connecting rod 553 can slidably insert through the inserting hole 5132 of the valve chamber 513 and partially extend out of the valve chamber 513. The first driving member 57 can be assembled to an end of the connecting rod 553 extending out of the valve chamber 513. The first driving member 57 can be configured for driving the sealing head 551 to slide along the first guiding wall 5133 and the second guiding wall 5135, and further driving the sealing head 511 to resist the supporting wall 5137, thereby isolating the connecting chamber 512 from the valve chamber 513.

The second vacuum pump 60 can be coupled to the mounting wall 5151 of the discharging chamber 515 and configured for exhausting air out of the discharging chamber 515 to create a vacuum inside the discharging chamber 515. A vacuum degree of the discharging chamber 515 can be equal to a vacuum degree of the vacuum forming chamber 10.

The discharging assembly 70 can be partially and slidably received in the vacuum container 50. The discharging assembly 70 can include a retrieving member 71, and a second driving member 73 assembled to the retrieving member 71. The second driving member 73 can be located outside of the discharging chamber 515. The retrieving member 71 can include an extendable rod 712, and a retrieving portion 715 assembled to an end of the extendable rod 712. The extendable rod 712 can be coupled to the second driving member 73, and be driven by the second driving member 73 to extend through the side wall 5153 into the discharging passage 511. In the embodiment, the extendable rod 712 can hermetically extend through the side wall 5153 to maintain the vacuum degree of the discharging chamber 515. The retrieving portion 715 can be a substantially rectangular basket and be received in the discharging passage 511.

In use, the sealing member 55 can hermetically isolate the vacuum forming chamber 10 from the discharging chamber 515, and the sealing cover 53 can seal the outlet 5157. The second vacuum pump 60 can be turned on to exhaust the discharging chamber 515 until the vacuum degree of the discharging chamber 515 is equal to that of the vacuum forming chamber 10. The sealing member 55 can be moved toward the top wall 5131 to allow the valve chamber 513 to fluidly communicate between the connecting chamber 512 and the discharging chamber 515. The second driving member 73 drives the retrieving portion 715 to move into the vacuum forming chamber 10 to fetch the workpiece from the mould 30. After the retrieving portion 715 fetches the workpiece, the second driving member 73 withdraws to pull the retrieving portion 715 back into the discharging chamber 515. The first driving member 57 drives the sealing head 551 toward the supporting wall 5137 to isolate the vacuum forming chamber 10 from the discharging chamber 515. The sealing cover 53 is rotated to open the outlet 5157, the second driving member 73 rotates the retrieving portion 715 to allow the workpiece to drop onto the sealing cover 53, and the workpiece slides along the sealing cover 53 into the collection box 80.

Figure 4:
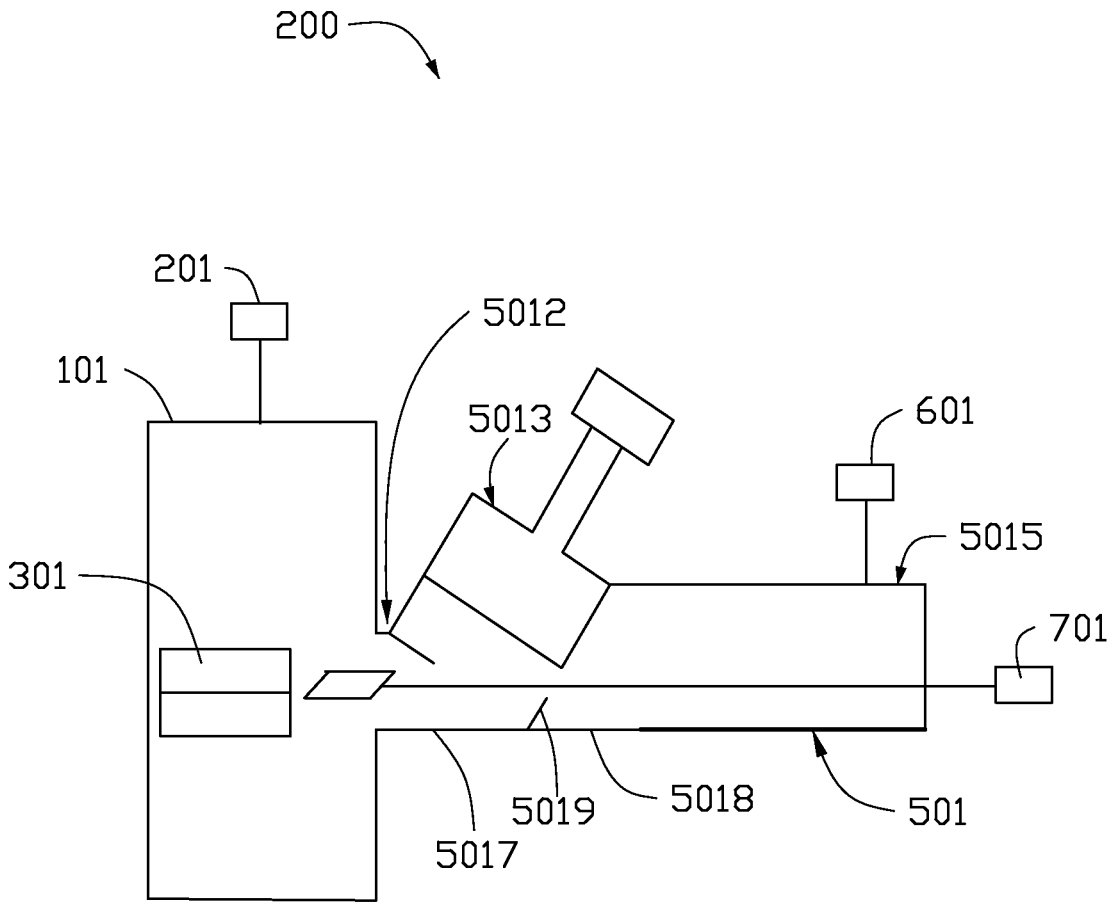
FIG. 4 shows a second embodiment of a vacuum forming device.

FIG. 4 illustrates a second embodiment of a vacuum forming device 200. The vacuum forming device 200 can include a vacuum forming chamber 101, a first vacuum pump 201, a mould 301, a vacuum container 501, a second vacuum pump 601, and a discharging assembly 701. The vacuum container 501 can include a connecting chamber 5012, a discharging chamber 5015, and a valve chamber 5013. The valve chamber 5013 can interconnect the connecting chamber 5012 and the discharging chamber 5015. The difference between the vacuum forming device 200 and the vacuum forming device 100 is that a bottom surface 5017 of the connecting chamber 5012 can be coplanar with an outlet wall 5018 of the discharging chamber 5015. A sealing surface 5019 can extend from the bottom surface 5017 and can be inclined toward the valve chamber 5013. The sealing surface 5019 can extend from a joint portion of the bottom surface 5017 and the outlet wall 5018.

The sealing cover 53, the outlet 5157, the first vacuum pump 20, and the second vacuum pump 60 can be omitted, such that the workpiece is directly collected in the vacuum container 50, as long as the vacuum container 50 can be disassembled from the vacuum forming chamber 10 to remove the workpiece. When the connecting rod 5132 is operated manually, the first driving member 57 can be omitted.

While the present disclosure has been described with reference to particular embodiments, the description is illustrative of the disclosure and is not to be construed as limiting the disclosure. Therefore, those of ordinary skill in the art can make various modifications to the embodiments without departing from the true spirit and scope of the disclosure, as defined by the appended claims.

What is claimed is:

1. A vacuum container configured to be coupled to a vacuum forming chamber of a vacuum forming device, comprising:

a connecting chamber defining an inclined sealing surface at a bottom surface, the connecting chamber being coupled to the vacuum forming chamber;

a discharging chamber defining a discharging passage therein;

a valve chamber interconnecting the connecting chamber and the discharging chamber; and a sealing member slidably received in the valve chamber, wherein the sealing member is configured for sliding along a direction inclined toward an axis of the discharging passage, and reaching at the bottom surface of the connecting chamber, such that the sealing member resists the inclined sealing surface to isolate the connecting chamber from the discharging chamber.

2. The vacuum container of claim 1, wherein the discharging chamber further defines an outlet fluidically communicating with the discharging passage, the vacuum container further comprises a sealing cover pivotably coupled to the discharging chamber, the sealing cover is configured to seal the outlet, when the sealing cover is rotated to beneath the outlet, the sealing cover is inclined toward the discharging chamber to permit a workpiece to slide from the discharging chamber to the sealing cover, and the workpiece slides along the sealing cover to a pre-set position.

3. The vacuum container of claim 1, wherein the valve chamber comprises a top wall, a first guiding wall, a second guiding wall and a supporting wall, the first guiding wall perpendicularly extends from an edge of the top wall and is coupled to a top of the connecting chamber, the second guiding wall perpendicularly extends from an edge of the top wall opposite to the first guiding wall and enters into the discharging chamber, the second guiding wall is parallel to the first guiding wall and coplanar to the inclined sealing surface, the supporting wall extends from an end of the first guiding wall away from the top wall, and protrudes toward the second guiding wall, the supporting wall is parallel to the top wall, the sealing member is received in the valve chamber and opposite sides of the sealing member respectively resist the first guiding wall and the second guiding wall.

4. The vacuum container of claim 3, wherein the first guiding wall and the supporting wall are spaced from the bottom surface of the connecting chamber, the second guiding wall is spaced from the inclined sealing surface, the second guiding wall and the inclined sealing surface form a through passage therebetween, the through passage interconnects the discharging passage and the vacuum forming chamber.

5. The vacuum container of claim 3, wherein the top wall defines an inserting hole, the sealing member comprising a sealing head and a connecting rod protruding from an end of the sealing head, opposite sides of the sealing head respectively resist the first guiding wall and the second guiding wall, the connecting rod slidably penetrates through the inserting hole and is partially exposed out of the valve chamber, the vacuum container further comprises a first driving member assembled to the connecting rod, the first driving member is configured for driving the sealing head to slide along the first guiding wall and the second guiding wall, and enables the sealing head to resist the supporting wall and the inclined sealing surface, causing the sealing member to isolate the connecting chamber from the valve chamber.

6. The vacuum container of claim 3, wherein the discharging chamber comprises a mounting wall, a side wall, and an outlet wall, the mounting wall is coupled to a jointing portion of the top wall and the second guiding wall, the side wall perpendicularly extends from an edge of the mounting wall away from the valve chamber, the outlet wall perpendicularly extends from an edge of the side wall away from the mounting wall and is coupled to the inclined sealing surface, and the outlet wall is be arranged parallel to the mounting wall, the outlet is defined on the outlet wall.

7. The vacuum container of claim 6, wherein the outlet wall and the mounting wall are arranged along a horizontal direction, the outlet wall is parallel to the bottom surface of the valve chamber and is disposed above the bottom surface of the connecting chamber opposite edges of the inclined sealing surface are connected to the surface and the outlet wall.

8. The vacuum container of claim 6, wherein the bottom surface of the connecting chamber is coplanar to the outlet wall, the sealing surface is coupled to jointing edges of the bottom surface and the outlet wall and extends toward the valve chamber.

9. A vacuum forming device, comprising:

a vacuum forming chamber; and a vacuum container, comprising:

a connecting chamber defining an inclined sealing surface at a bottom surface, the connecting chamber being coupled to the vacuum forming chamber;

a discharging chamber defining a discharging passage therein;

a valve chamber interconnecting the connecting chamber and the discharging chamber; and a sealing member slidably received in the valve chamber, wherein the sealing member is configured for sliding along a direction inclined toward an axis of the discharging passage, and reaching at the bottom surface of the connecting chamber such that the sealing member resists the inclined sealing surface to isolate the connecting chamber from the discharging chamber.

10. The vacuum forming device of claim 9, wherein the discharging chamber further defines an outlet fluidically communicating with the discharging passage, the vacuum container further comprises a sealing cover pivotably coupled to the discharging chamber, the sealing cover is configured to seal the outlet, when the sealing cover is rotated to beneath the outlet the sealing cover is inclined toward the discharging chamber to permit a workpiece to slide from the discharging chamber to the sealing cover, and the workpiece slides along the sealing cover to a pre-set position.

11. The vacuum forming device of claim 9, wherein the valve chamber comprises a top wall, a first guiding wall, a second guiding wall and a supporting wall, the first guiding wall perpendicularly extends from an edge of the top wall and is coupled to a top of the connecting chamber the second guiding wall perpendicularly extends from an edge of the top wall opposite to the first guiding wall and enters into the discharging chamber, the second guiding wall is parallel to the first guiding wall and coplanar to the inclined sealing surface, the supporting wall extends from an end of the first guiding wall away from the top wall, and protrudes toward the second guiding wall, the supporting wall is parallel to the top wall, the sealing member is received in the valve chamber and opposite sides of the sealing member respectively resist the first guiding wall and the second guiding wall.

12. The vacuum forming device of claim 11, wherein the first guiding wall and the supporting wall are spaced from the bottom surface of the connecting chamber, the second guiding wall is spaced from the inclined sealing surface, the second guiding wall and the inclined sealing surface form a through passage therebetween, the through passage interconnects the discharging passage and the vacuum forming chamber.

13. The vacuum forming device of claim 11, wherein the top wall defines an inserting hole, the sealing member comprising a sealing head and a connecting rod protruding from an end of the sealing head, opposite sides of the sealing head respectively resist the first guiding wall and the second guiding wall, the connecting rod slidably penetrates through the inserting hole and is partially exposed out of the valve chamber, the vacuum container further comprises a first driving member assembled to the connecting rod, the first driving member is configured for driving the sealing head to slide along the first guiding wall and the second guiding wall, and enables the sealing head to resist the supporting wall and the inclined sealing surface, causing the sealing member to isolate the connecting chamber from the valve chamber.

14. The vacuum forming device of claim 11, wherein the discharging chamber comprises a mounting wall, a side wall, and an outlet wall, the mounting wall is coupled to a jointing portion of the top wall and the second guiding wall, the side wall perpendicularly extends from an edge of the mounting wall away from the valve chamber, the outlet wall perpendicularly extends from an edge of the side wall away from the mounting wall and is coupled to the inclined sealing surface and the outlet wall is arranged parallel to the mounting wall, the outlet is defined on the outlet wall.

15. The vacuum forming device of claim 14, wherein the outlet wall and the mounting wall are arranged along a horizontal direction, the outlet wall is parallel to the bottom surface of the valve chamber and is disposed above the bottom surface of the connecting chamber opposite edges of the inclined sealing surface are connected to the bottom surface and the outlet wall.

16. The vacuum forming device of claim 14, wherein the bottom surface of the connecting chamber is coplanar to the outlet wall, the sealing surface is coupled to jointing edges of the bottom surface and the outlet wall and extends toward the valve chamber.

17. The vacuum forming device of claim 9, further comprising a discharging assembly, wherein the discharging assembly comprises a retrieving member and a driving member assembled to the retrieving member, the retrieving member comprises an extensible rod and a retrieving portion assembled to an end of the extensible rod, the extensible rod penetrates through the discharging chamber and is partially received in the discharging passage, the driving member is assembled to an end of the extensible rod away from the retrieving portion, and configured for driving the retrieving portion to fetch a workpiece in the vacuum forming device.

18. The vacuum forming device of claim 9, further comprising a first vacuum pump coupled to the vacuum forming chamber, and a second vacuum pump coupled to the discharging chamber, the first vacuum pump is configured for exhausting air from the vacuum forming chamber, the second vacuum pump is configured for exhausting air from the discharging chamber to enable the discharging chamber to remain a vacuum degree equal to that of the vacuum forming chamber.

19. A vacuum container couplable to a vacuum forming chamber, the vacuum container comprising:

a connecting chamber couplable to the vacuum container, the connecting chamber having a bottom surface with a sealing surface inclined away from the vacuum forming chamber;

a discharging chamber having a discharging passage extending in a first direction along a first axis;

a valve chamber connecting the connecting chamber to the discharging chamber, the valve chamber extending along a second axis; and a sealing member slidable along the second axis toward the first axis and positioned in the valve chamber such that a first side of the sealing member is substantially sealed from a second side of the sealing member;

wherein, the first axis is at an acute angle to the second axis; and wherein, when the sealing member is positioned against the sealing surface, the connecting chamber is isolated from the discharging chamber.

* * * * *